US005481884A

United States Patent [19]

Scoccia

[11] Patent Number: 5,481,884

[45] Date of Patent: Jan. 9, 1996

[54] APPARATUS AND METHOD FOR PROVIDING LOW REFRIGERANT CHARGE DETECTION

[75] Inventor: Ardeean Scoccia, Amherst, N.Y.

[73] Assignee: General Motors Corporation, Detroit, Mich.

[21] Appl. No.: 297,466

[22] Filed: Aug. 29, 1994

[51] Int. Cl.[6] ..... F25B 49/02

[52] U.S. Cl. ..... 62/129; 62/127

[58] Field of Search ..... 62/125, 126, 127, 62/129, 208, 209, 158, 157, 231, 227, 226, 228.3

[56] References Cited

U.S. PATENT DOCUMENTS

| | | | |
|---|---|---|---|
| 4,220,010 | 9/1980 | Mueller et al. | 62/126 |
| 4,395,886 | 8/1983 | Mayer | 62/160 |
| 4,563,878 | 1/1986 | Baglione | 62/209 X |
| 4,646,535 | 3/1987 | Matsouka et al. | 62/228.5 |
| 4,677,830 | 7/1987 | Sumikawa et al. | 62/126 |
| 4,745,765 | 5/1988 | Pettitt | 62/129 |
| 4,829,777 | 5/1989 | Matsuoka et al. | 62/212 |
| 5,009,074 | 4/1991 | Goubeaux et al. | 62/115 |
| 5,009,076 | 1/1991 | Winslow | 62/129 |
| 5,150,584 | 9/1992 | Tomasov et al. | 62/209 |
| 5,152,152 | 10/1992 | Brickner et al. | 62/126 |
| 5,186,014 | 2/1993 | Runk | 62/129 |
| 5,201,862 | 4/1993 | Pettitt | 62/157 |
| 5,251,453 | 10/1993 | Stanke et al. | 62/126 |
| 5,285,648 | 2/1994 | Bessler | 62/129 |

*Primary Examiner*—Harry B. Tanner
*Attorney, Agent, or Firm*—Howard N. Conkey

[57] ABSTRACT

In a refrigeration system, an apparatus and method for providing low refrigerant charge detection before and during compressor operation. For detection before compressor operation, a very low refrigerant charge condition is indicated if the measured refrigerant pressure at the inlet of the compressor is too low based on a comparison of the measured pressure and a reference pressure related to the saturation pressure at the measured ambient temperature. If a low refrigerant charge condition is detected, the compressor may be inhibited from operating. If the system is stable with compressor non-operation, a warning also occurs. While the compressor is operating, a moderately low refrigerant charge condition is detected if the measured refrigerant temperature at the inlet of the compressor is too high based on a comparison of the measured temperature and a reference temperature related to the saturation temperature of the refrigerant for the measured refrigerant pressure. If a moderately low refrigerant charge condition is detected, two levels of warning can occur, for servicing and for indicating a severe condition so compressor operation may be disabled, depending on the discrepancy.

10 Claims, 3 Drawing Sheets

APPARATUS AND METHOD FOR PROVIDING LOW REFRIGERANT CHARGE DETECTION

BACKGROUND OF THE INVENTION

The present invention relates to an apparatus and method for detecting low refrigerant charge in a refrigeration system.

Automotive air conditioning (A/C) systems employ a mixture of refrigerant and oil, hereinafter referred to as refrigerant charge. A compressor receives necessary lubrication from the oil in the refrigerant charge and circulates the refrigerant charge through the system's condenser, expansion device and evaporator in a refrigeration cycle. Should refrigerant charge drop in volume due to a system leak, improper service or otherwise, the compressor may not receive sufficient lubrication and will eventually become damaged if allowed to operate. It is recognized, therefore, that low refrigerant charge detection is desirable as part of an air conditioning system which is responsive thereto to terminate the system operation prior to the compressor becoming damaged. The compressor may be driven internally by an electric motor or by an automobile engine and coupled thereto via an electromagnetic cycling clutch which engages the compressor to the driving source. A low refrigerant charge typically causes disengagement of the cycling clutch to prevent compressor damage.

There are various known devices or schemes for detecting an insufficiency of refrigerant charge in an operating refrigeration system. Based on specified parameters for various types of systems, the operating compressor is disengaged if the refrigerant charge is determined to be too low. Some detection plans are specific for either fixed or variable displacement compressors while others work for either type of compressor. One scheme for an automotive air conditioning system with an engine driven, fixed displacement compressor uses a load signal (ambient temperature), two capacity signals (evaporator temperature and vehicle speed) and vehicle-specific calibrations to predict the refrigerant charge level and to disable the compressor when the predicted charge is below a predetermined level. Another monitors refrigerant temperature upstream and downstream of the expansion device and checks for a differential value within a predetermined acceptable range. One plan for automotive air conditioning systems with an engine driven, variable displacement compressor requires measuring the response time of the low side pressure as displacement is changed from minimum to maximum. In another detection plan, a mechanical detection device located at the evaporator outlet is triggered by the combination of refrigerant pressure and ambient air temperature to determine low charge while the system is operating. Another method provides for detecting evaporator pressure and temperature and disengaging the clutch if the pressure is too low and the temperature is too low or too high as compared to predetermined fixed values. One embodiment of this method checks if the amount of superheat is too high by comparing the saturation temperature based on the measured refrigerant pressure to the measured temperature. If the measured temperature is too high and the measured pressure is too low, the clutch is disengaged.

One scheme, for either fixed or variable displacement compressors, measures refrigerant temperature at the inlet and outlet of the evaporator and monitors the difference. This scheme also looks at variations in evaporator refrigerant temperature between when the compressor is off and when the compressor is on. Another plan monitors evaporator inlet and outlet temperatures and compressor body temperature while the system is running. Very low charge is detected when the difference between the refrigerant temperatures is large and the body temperature is high.

The above described low refrigerant charge detection plans generally require the system to be operating to obtain most measurements. However, if the refrigerant charge is very low, there is a potential of compressor damage if the compressor is started when the low charge condition exists.

SUMMARY OF THE INVENTION

This invention provides low refrigerant charge detection before and during compressor operation. The before compressor operation detection indicates whether or not the refrigerant charge level is acceptable for compressor operation to begin while the during compressor operation detection provides two levels of indication representative of the degree of a low charge condition. For detection before compressor operation, this invention determines that the refrigerant charge is too low by measuring the refrigerant pressure at the inlet of the compressor and the existing ambient temperature and determining if the measured pressure is too low based on a comparison of the measured pressure and a reference pressure related to the saturation pressure at the measured ambient temperature. Typically, this reference pressure is selected such that measured pressures lower than the reference pressure indicate that only vapor exists in the system. This condition is representative of a very low refrigerant charge and is indicated, for example, by activating a Service Soon signal. Otherwise a satisfactory charge level is indicated such as by setting a flag indicating VERY LOW REFRIGERANT CHARGE NOT DETECTED.

This invention further recognizes that the refrigerant pressure becomes equalized only when compressor non-operation occurs for at least a predetermined length of time. Since it is possible that the compressor has been operated recently thus giving an erroneously low pressure (at the during-operation low pressure side of the system), the invention also monitors how long the compressor has been in the non-operating condition. A low charge condition is sensed and indicated only if the compressor has been in the non-operating condition for a sufficient time for the system to be equalized, or stable, with compressor non-operation and the refrigerant pressure is still very low.

This invention further provides an improved apparatus and method for indicating, while the compressor is operating, moderate losses of refrigerant to enable a service warning to be activated before eventually setting a LOW REFRIGERANT CHARGE DETECTED flag that may be used by a controller to command that compressor operation be disabled. This invention identifies that the refrigerant temperature at the inlet of the compressor is too high as determined by the saturation temperature of the refrigerant for the existing refrigerant pressure. When the compressor is operating, the refrigerant pressure and refrigerant temperature are monitored. If the system has stabilized with compressor operation, the refrigerant temperature is compared to a value determined by the saturation temperature of the refrigerant for the measured refrigerant pressure. This scheme detects the amount of superheat in the system. Generally, a higher amount of superheat indicates an insufficiency of refrigerant charge. If the measured refrigerant temperature is too high, the system sends a Service Soon signal and may set a second flag indicating LOW REFRIG- ERANT CHARGE DETECTED, depending on the severity of the discrepancy.

The above and other advantages of the invention will become more apparent from the following description taken in conjunction with the accompanying drawings.

DETAILED DESCRIPTION OF THE INVENTION

Figure 1:
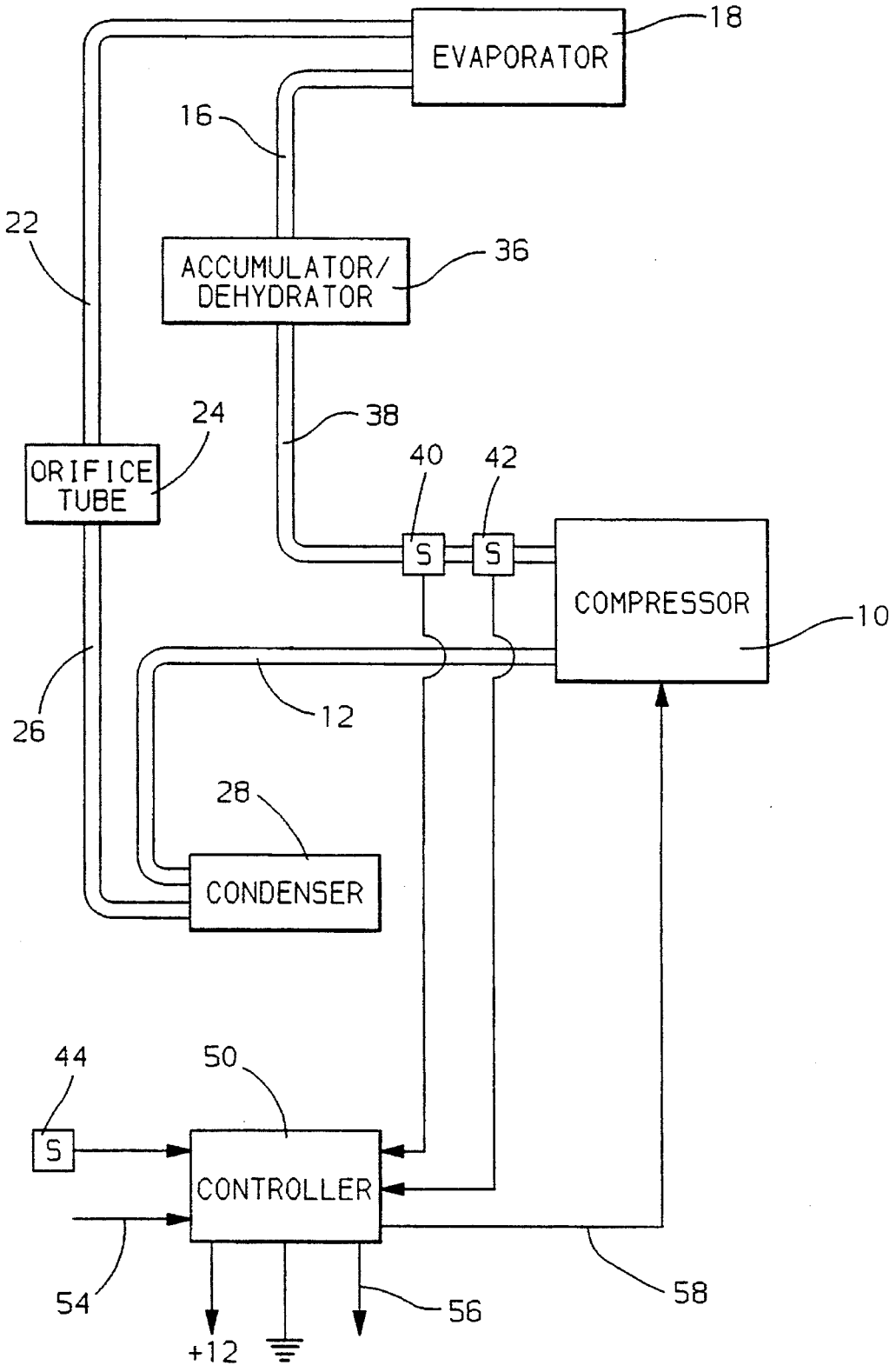
FIG. 1 is a block diagram of an air conditioning only system, commonly used on automotive vehicles.

Refrigeration systems include air conditioning only systems and heat pump systems which consist essentially of the same elements. It will be recognized that this invention may be used for either a heat pump or air conditioning only system. The invention as described applies equally to an electric vehicle or an engine driven vehicle. FIG. 1 shows an automotive air conditioning only system consisting essentially of a compressor 10, a condenser 28, an orifice tube 24, and an evaporator 18.

When operating, the compressor 10 ingests low-pressure/low-temperature refrigerant vapor from a vapor return line 38, compresses the same and discharges high-pressure/high-temperature refrigerant vapor through a discharge line 12. This discharged vapor flows through the discharge line 12 to the condenser 28, where it undergoes state transformation into high-pressure/high-temperature liquid, and continues on. A liquid line 26 routes the refrigerant to the orifice tube 24 which the refrigerant enters under high pressure and exits under low pressure to a line 22 leading to the evaporator 18. The refrigerant vaporizes within the evaporator 18 and travels through a vapor return line 16. The refrigerant then flows to an accumulator/dehydrator 36. There, the refrigerant is dried with a desiccant, and any residual liquid is retained. The refrigerant then flows through the vapor return line 38 past a refrigerant temperature sensor 40, preferably composed of a thermistor, and a refrigerant pressure sensor 42, preferably composed of a pressure transducer, and is again ingested into the compressor 10 in a continuous refrigeration cycle.

The compressor 10 may be either a type having a fixed or variable volume displacement. The orifice tube 24 may be of the fixed or variable orifice type. It will be recognized that instead of using the orifice tube 24 and the accumulator/dehydrator 36, any expansion device may be placed in line before the evaporator 18. The expansion device may be a thermal expansion valve and receiver which is generally known, and is designed to pass only as much refrigerant as will vaporize for the then existing heat load. Other types of variable orifice expansion valves may be employed within the scope of the invention.

A controller 50 generally comprises a microprocessor based electrical circuit. The controller 50 may be a dedicated air conditioning system controller or, more typically, may be a larger controller that performs additional functions on the vehicle. The controller 50 receives input information from an ambient temperature sensor 44, the refrigerant temperature sensor 40, the refrigerant pressure sensor 42, and a compressor requested signal 54. The compressor requested signal 54 may be based on operator-controlled settings in the vehicle or may be determined by other parts of a vehicle system controller. The ambient temperature sensor 44 may be a thermistor or the like and may, for example, comprise an outside air temperature sensor used for driver information.

The outputs from the controller 50 may include a compressor command 58 which provides information to operate the compressor 10 and a Service Soon signal 56 which indicates a low refrigerant charge condition. The Service Soon signal 56 can be any type of warning signal to indicate that the system is not operating normally. The compressor command 58 may be an on/off signal instructing a compressor motor to turn on or an electromagnetic cycling clutch to engage the compressor if the controller 50 determines this is appropriate based on the settings of the VERY LOW REFRIGERANT CHARGE NOT DETECTED and LOW REFRIGERANT CHARGE DETECTED flags and/or other conditions detected in the system. The controller 50 may contain a flag indicating if the compressor is not currently on (cycling clutch disengaged or motor turned off). The Service Soon signal 56 is used to activate a Service Soon light in the vehicle passenger compartment and a diagnostic code. Read only memory (ROM) within the controller 50 contains calibration tables of data necessary for the various control functions performed by the controller 50.

Figure 2:
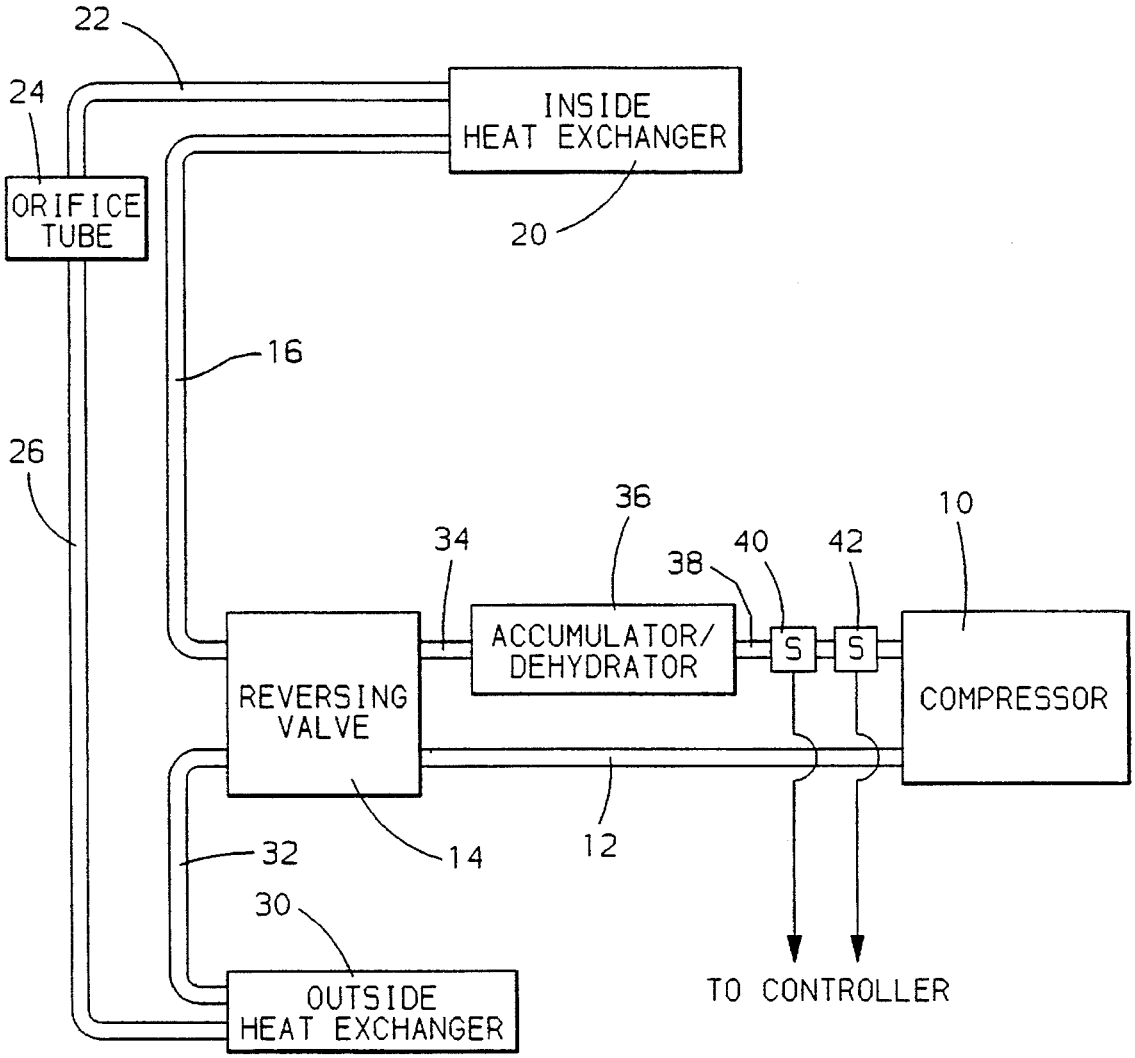
FIG. 2 is a block diagram illustrating the location of the fluid components when the invention is embodied in a heat pump system.

FIG. 2 shows the location of the fluid components when the invention is embodied in a heat pump system. The heat pump system operates essentially as the air conditioning system above with the inclusion of a reversing valve 14 enabling an outside heat exchanger 30 to operate as a condenser or an evaporator and an inside heat exchanger 20 to operate as an evaporator or a condenser depending on the desired mode of operation—either cooling or heating. As the invention operates in essentially the same manner as described above for the air conditioning only system (shown in FIG. 1), only the additional elements required by this embodiment will be described. A reversing valve 14 is connected between the outlet of the compressor, the inside heat exchanger, the outside heat exchanger, and the inlet line of the accumulator/dehydrator 36. Depending on the direction of the reversing valve, either heat exchanger will act as a condenser or an evaporator. Lines for connecting the reversing valve to the system 32 and 34 are added.

Figure 3:
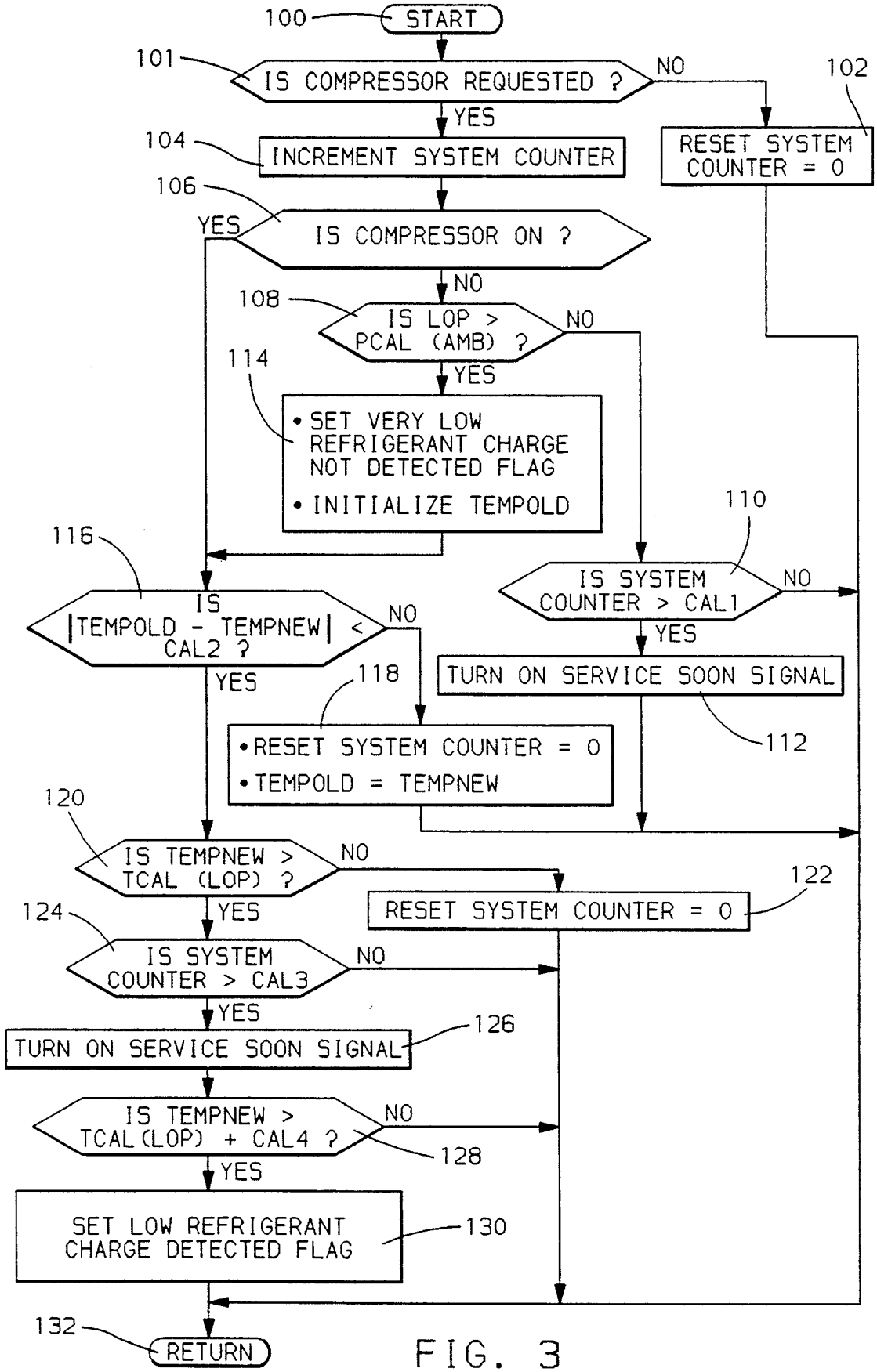
FIG. 3 is a flowchart for controlling the low refrigerant charge detection.

FIG. 3 depicts a flow diagram representative of computer program instructions repeatedly executed by the controller 50 at constant intervals. The low refrigerant detection program is entered at step 100 and begins executing the steps as shown. Step 101 first determines if compressor operation has been requested. If compressor operation has not been requested, a system counter is reset to zero at step 102. The program next proceeds to step 132 where control is returned to the background program.

Assuming compressor operation has been requested, the program proceeds from step 101 to step 104 which increments an accumulated value in the system counter. This accumulated value is used in various steps to determine the minimum time that a specified condition has occurred. Next, at step 106, the program senses the state of the compressor operation. If the compressor is not currently on (cycling clutch disengaged or motor turned off), as may be indicated by an appropriate flag in the controller or by monitoring the level of the compressor command from the controller, the program proceeds to step 108 where it is determined if the measured refrigerant pressure, low side pressure (LOP), is above PCAL(AMB). PCAL(AMB) is a predetermined value representing the lowest acceptable refrigerant charge for the existing (measured) ambient temperature (AMB). Values for PCAL(AMB) are stored in a look-up table and are based on the refrigerant saturation pressure for the refrigerant at the given ambient temperature. The values in the PCAL(AMB) table are established such that a system with sufficient refrigerant charge will have a pressure higher than the value in the table. Basing the lowest acceptable refrigerant pressure on the existing ambient temperature recognizes the fact that as ambient temperature rises, the pressure in the system also rises. This method does not set the first flag indicating VERY LOW REFRIGERANT CHARGE NOT DETECTED if the low side refrigerant pressure in the system is equal to or below a predetermined value based on the measured ambient temperature. This low pressure indicates that sufficient charge has left the system such that only vapor is present in the system. In response to the reset condition of this flag indicating a low refrigerant charge, the controller 50 may command that compressor operation be inhibited to prevent potential damage to the compressor.

To allow for the possibility that the pressures in the system have not equalized due to recent compressor operation, the accumulated value of the system counter is compared to CAL1 at step 110. CAL1 is a predetermined time period representing a period of time after which the system is stable with compressor non-operation. If the system counter is not sufficiently high, the program returns to background at step 132. If the system counter is greater than CAL1 at step 110, this indicates that the system is stable with compressor non-operation, and the refrigerant pressure is still too low. Therefore a very low refrigerant charge exists, a Service Soon signal 56 is activated at step 112, and the program returns to background at step 132.

If the refrigerant low side pressure (LOP) is greater than the value from the PCAL(AMB) table at step 108, the VERY LOW REFRIGERANT CHARGE NOT DETECTED flag is set and the controller 50 may use this flag and other conditions to determine whether to operate the compressor 10. The refrigerant temperature TEMPOLD is initialized at step 114. TEMPOLD can be set to any value such that the absolute value of TEMPOLD–TEMPNEW will not be less than CAL2 at step 116. This insures that the program proceeds to step 118 for the program cycle in which the VERY LOW REFRIGERANT CHARGE NOT DETECTED FLAG is set. For example, TEMPOLD can be set to TEMPNEW+CAL2.

The operating system is monitored to detect low refrigerant charge conditions. The program proceeds to step 116 where a check is made to determine whether the system is now stable in the compressor operating state. This check is performed by comparing the current refrigerant temperature TEMPNEW at the inlet of the compressor with the stored previous refrigerant temperature value TEMPOLD. When the absolute value of the change between TEMPOLD and TEMPNEW is less than CAL2 at step 116, the system is considered stable. CAL2 is a predetermined value representing a maximum difference that the refrigerant temperature can change and still be considered stable. If the temperature has changed an amount greater than CAL2 at step 116, TEMPOLD is set equal to the current temperature TEMPNEW at step 118, the system counter is reset to zero at step 118, and the program returns to background at step 132.

If the system is stable, as determined in step 116, the temperature TEMPNEW is compared at step 120 to a value in a TCAL(LOP) table of temperature versus refrigerant pressure LOP. This table is configured such that the temperatures tabulated are a fixed amount above the refrigerant saturation temperature at a given pressure. This corresponds to an amount of refrigerant superheat higher than normal, which indicates insufficient refrigerant charge. If the current refrigerant temperature TEMPNEW is not higher than the value in the TCAL(LOP) table, then the system is operating normally, the system counter is reset at step 122, and the program returns to background at step 132.

If the current refrigerant temperature TEMPNEW is higher than the value in the table TCAL(LOP) at step 120, then the system counter is checked to see if the value CAL3 has been exceeded at step 124. CAL3 is a predetermined value representing a period of time which the refrigerant temperature must be above the critical temperature before a Service Soon signal 56 occurs. If the system counter has exceeded the value of CAL3, then the Service Soon signal 56 is activated at step 126. If the current refrigerant temperature TEMPNEW is greater than the value in the table TCAL(LOP) by an amount higher than a predetermined value CAL4 at step 128, then the second flag indicating LOW REFRIGERANT CHARGE DETECTED is set at step 130. Based on the setting of this second flag, the controller 50 may send a compressor command or set an appropriate flag to disable the compressor 10. If the current refrigerant temperature TEMPNEW is not greater than the value in the table TCAL(LOP) by an amount higher than CAL4 at step 128, the program returns to background at step 132, and the second flag indicating LOW REFRIGERANT CHARGE DETECTED is not set. The system as described continues to run through the control program, shown in FIG. 3, at predetermined intervals. Turning on the Service Soon signal 56, setting either VERY LOW REFRIGERANT CHARGE NOT DETECTED flag or LOW REFRIGERANT CHARGE DETECTED flag does not lock out compressor operation if the detected conditions change. The system counter is reset each time vehicle operation is initiated during controller 50 initialization so that the refrigerant level is monitored each time the vehicle is operated. It will be recognized that this system can also be implemented so that when the LOW REFRIGERANT CHARGE DETECTED flag is set, it remains set until the system is serviced.

The foregoing description of a preferred embodiment of the invention for the purpose of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. An apparatus for providing low refrigerant charge detection in a refrigeration system charged with a refrigerant and having a compressor with an inlet for receiving the refrigerant, the apparatus comprising:

means for sensing one of an operating and a non-operating states of the compressor;

means for measuring refrigerant pressure at the inlet of the compressor;

means for measuring ambient air temperature; and means for indicating very low refrigerant charge not detected when (i) the compressor is sensed in the non-operating state, and (ii) the measured refrigerant pressure is greater than a pressure value that is a predetermined function of the measured ambient air temperature.

2. The apparatus of claim 1 further comprising:

means for sensing if the refrigeration system is stable with non-operation of the compressor, the means for sensing stable system with non-operation of the compressor including (i) a system counter having an accumulated value, (ii) means for detecting a compressor requested signal, (iii) means for incrementing at constant intervals the accumulated value of the system counter when the compressor requested signal is detected, and (iv) means for indicating the system is stable with non-operation of the compressor when the accumulated value is greater than a predetermined time period and non-operation of the compressor is sensed; and means for activating a warning signal when (i) very low refrigerant charge not detected is not indicated and (ii) the system is stable with non-operation of the compressor.

3. The apparatus of claim 1 further comprising:

means for measuring refrigerant temperature at the inlet of the compressor;

means for sensing if, after compressor operation is sensed in the operating state, the system is stable with compressor operation; and means for indicating low refrigerant charge detected when (i) the refrigerant temperature is above a temperature value that is a first predetermined function of the measured refrigerant pressure and (ii) the system is stable with compressor operation.

4. The apparatus of claim 3 wherein the means for sensing if the system is stable with compressor operation further comprising:

means for storing a previous value of the refrigerant temperature;

means for calculating a change between the stored refrigerant temperature and the measured refrigerant temperature; and means for indicating that the system is stable with compressor operation when the change is less than a predetermined value.

5. The apparatus of claim 3 further comprising means for activating a warning signal when the refrigerant temperature is above a temperature value that is a second predetermined function of the refrigerant pressure.

6. A method for providing low refrigerant charge detection in a refrigeration system charged with a refrigerant and having a compressor with an inlet for receiving the refrigerant, the method comprising the steps of:

sensing one of an operating and a non-operating states of the compressor;

measuring refrigerant pressure at the inlet of the compressor;

measuring ambient air temperature; and indicating very low refrigerant charge not detected when (i) the compressor is sensed in the non-operating state, and (ii) the measured refrigerant pressure is greater than a pressure value that is a predetermined function of the measured ambient air temperature.

7. The method of claim 6 further comprising:

sensing if the refrigeration system is stable with non-operation of the compressor, the step of sensing stable system with non-operation of the compressor further including (i) detecting a compressor requested signal, (ii) incrementing at constant intervals an accumulated value of a system counter when the compressor requested signal is detected, and (iii) indicating the system is stable with non-operation of the compressor when the accumulated value is greater than a predetermined time period and non-operation of the compressor is sensed; and activating a warning signal when (i) very low refrigerant charge not detected is not indicated and (ii) the system is stable with non-operation of the compressor.

8. The method of claim 6 further comprising the steps of:

measuring refrigerant temperature at the inlet of the compressor;

sensing if, after the compressor is sensed in the operating state, the system is stable with compressor operation; and indicating that low refrigerant charge exists when (i) the refrigerant temperature is above a temperature value that is a predetermined function of the measured refrigerant pressure and (ii) the system is stable with compressor operation.

9. The method of claim 8 wherein the step of sensing if the system is stable with compressor operation further comprises the steps of:

storing a previous value of the refrigerant temperature;

calculating a change between the stored refrigerant temperature and the measured refrigerant temperature; and indicating that the system is stable with compressor operation when the change is less than a predetermined value.

10. The method of claim 8 further comprising the step of activating a warning signal when the refrigerant temperature is above a temperature value that is a second predetermined function of the refrigerant pressure.

* * * * *